US007264856B2

(12) United States Patent
Wexler et al.

(10) Patent No.: US 7,264,856 B2
(45) **Date of Patent: *Sep. 4, 2007**

(54) FUSIBLE INKJET RECORDING ELEMENT AND PRINTING METHOD

(75) Inventors: Allan Wexler, Pittsford, NY (US); Paul D. Yacobucci, Rochester, NY (US); Kurt M. Schroeder, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/084,986

(22) Filed: Mar. 21, 2005

(65) Prior Publication Data

US 2006/0210731 A1 Sep. 21, 2006

(51) Int. Cl.
*B41M 5/40* (2006.01)

(52) U.S. Cl. ..... 428/32.34; 428/32.24; 428/32.25; 428/32.27; 428/32.28; 428/32.35; 524/589; 524/590; 524/507; 523/123; 523/455; 347/101; 347/102; 347/105

(58) Field of Classification Search ..... 428/32.1, 428/32.24, 32.25, 32.27, 32.28, 32.35; 524/589, 524/590, 507; 525/123, 455; 347/101, 102, 347/105

See application file for complete search history.

(56) References Cited

U.S. PATENT DOCUMENTS 5,027,131 A * 6/1991 Hasegawa et al. ..... 347/105
5,059,983 A * 10/1991 Higuma et al. ..... 428/32.24
6,087,051 A 7/2000 Shoji et al.
6,114,020 A * 9/2000 Misuda et al. ..... 428/32.35
6,139,940 A * 10/2000 Iwamoto et al. ..... 428/32.34
6,291,127 B1 * 9/2001 Dagan et al. ..... 430/201
6,312,858 B1 * 11/2001 Yacobucci et al. ..... 430/17
6,550,909 B2 * 4/2003 Ichinose et al. ..... 347/105
6,569,533 B1 * 5/2003 Uchida et al. ..... 428/423.1
6,616,992 B2 * 9/2003 Ito et al. ..... 428/32.25
6,649,232 B2 * 11/2003 Ito et al. ..... 428/32.13
6,777,038 B2 * 8/2004 Murasawa et al. ..... 428/32.15
6,815,018 B2 * 11/2004 Wexler et al. ..... 428/32.25
6,866,384 B2 * 3/2005 O'Connor et al. ..... 347/105
2001/0006720 A1 * 7/2001 Takahashi et al. ..... 428/195
2002/0048658 A1 * 4/2002 Takahashi et al. ..... 428/195
2004/0242763 A1 * 12/2004 Tielemans et al. ..... 524/589
2005/0162495 A1 * 7/2005 Wexler ..... 347/105

FOREIGN PATENT DOCUMENTS

EP 0 286 427 * 10/1988
EP 0 858 905 A1 8/1998

* cited by examiner

*Primary Examiner*—B. Shewareged
(74) *Attorney, Agent, or Firm*—Chris P Konkol

(57) ABSTRACT

An inkjet recording element comprising, over a porous, ink-receiving layer, a fusible, porous topmost layer comprising a film-forming, hydrophobic binder and fusible, polymeric particles of a non-segmented polyurethane, or salt thereof, comprising repeat units derived from a diisocyanate and a diol component comprising a mixture of diols, said diol mixture comprising: an anionically-substituted diol selected from carboxylic acid-, sulfonic acid-, and phosphonic acid-substituted diol and an ether containing short chain aliphatic diol, wherein the polyurethane has a Tg greater than about 70° C.

19 Claims, No Drawings

FUSIBLE INKJET RECORDING ELEMENT AND PRINTING METHOD

FIELD OF THE INVENTION

The present invention relates to a porous inkjet recording element.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An inkjet recording element typically comprises a support having on at least one surface thereof at least one ink-receiving layerink-receiving layer. The ink-receiving layer is typically either a porous layer that imbibes the ink via capillary action, or a polymer layer that swells to absorb the ink. Swellable hydrophilic polymer layers take an undesirably long time to dry compared to porous ink-receiving layers.

Porous ink-receiving layers are usually composed of inorganic or organic particles bonded together by a binder. The amount of particles in this type of coating is often far above the critical particle volume concentration (CPVC), which results in high porosity in the coating. During the inkjet printing process, ink droplets are rapidly absorbed into the coating through capillary action and the image is dry-to-touch right after it comes out of the printer.

Inkjet prints, prepared by printing onto inkjet recording elements, are subject to environmental degradation. They are especially vulnerable to damage resulting from contact with water and atmospheric gases such as ozone. Ozone bleaches inkjet dyes resulting in loss of density. The damage resulting from the post imaging contact with water can take the form of water spots resulting from deglossing of the top coat, dye smearing due to unwanted dye diffusion, and even gross dissolution of the image recording layer. To overcome these deficiencies, inkjet prints are often laminated. However, lamination is expensive, as a film laminate is a separate roll of material which -requires an adhesive layer prepared via an additional coating step. If the laminate is of the transfer type there is also added waste in the form of the exhausted coated support from which the laminate is transferred. Accordingly, efforts have been made to provide, in the form of a single sheet, an image-recording medium that has an uppermost fusible porous layer which functions as a latent protective layer. This layer generally comprises fusible thermoplastic particles. It is often characterized as an ink-transporting layer when it is not retentive of the ink or colorant, which passes through to an underlying layer. When the layer functions as an ink-transporting layer, fusing transforms it into a protective topcoat for the underlying image. This single-sheet media design thereby eliminates the need for lamination to protect inkjet prints.

There remain problems with this approach, however, in terms of choosing the appropriate thermoplastic material with which to form the fusible particles of the uppermost layer. Specifically, it is difficult to simultaneously meet the requirements of: fusibility, and then subsequent to fusing flexibility, and resistance to thermal blocking in the fused layer.

U.S. Pat. Nos. 4,785,313 and 4,832,984 relate to an inkjet recording element comprising a support having thereon a fusible, ink-transporting layer and an ink-retaining layer, wherein the ink-retaining layer is non-porous. However, there is a problem with this element in that fused prints crack when bent and they exhibit thermally blocking.

EP 858,905A1 relates to an inkjet recording element having a porous, outermost layer formed by heat sintering thermoplastic particles of latex such as polyurethane which may contain a slight amount of a hydrophilic binder such as poly(vinyl alcohol). However, there is a problem with this element in that it has poor resistance to mechanical abrasion, when it does not contain a hydrophilic binder, and poor water-resistance when it does contain a hydrophilic binder.

U.S. Pat. No. 6,087,051 relates to an information recording material having a support and an image carrier layer and an outermost protective covering layer on the image carrier layer, wherein the protective covering layer contains an aqueous polyurethane resin which comprises a polycarbonate ester. There is a problem with this element in that it exhibits thermal blocking.

U.S. Pat. No. 6,866,384 discloses particles of segmented and non-segmented polyurethane in fusible layer of inkjet media compared to particles made from cellulose acetate butyrate. The latter was found to provide superior thermal blocking and print cracking. However, the process to produce fusible particles made from cellulose acetate butyrate requires large amounts of organic solvents such as ethyl acetate.

It is an object of this invention to provide a porous uppermost layer that has good mechanical integrity and is abrasion resistant. It is another object of the invention to provide an uppermost layer that is thermally fusible and thereby can be transformed by fusing into a protective layer. It is desirable that the thermally fusible material can be prepared in and coated from an aqueous system. It is another object of the invention to provide an inkjet recording element wherein the uppermost layer is sufficiently flexible after fusing that it can be bent without excessive cracking. It is another object to provide an inkjet recording element wherein the fused uppermost layer doesn't exhibit thermal blocking. Achieving such a balance of properties is a significant challenge.

SUMMARY OF THE INVENTION

These and other objects are achieved in accordance with the invention which comprises an inkjet recording element comprising a support having thereon in order (from the support, i.e. from lower to upper layers, not necessarily adjacent to each other or the support):

a) at least one porous, ink-fluid receiving layer; and b) a fusible, porous topmost layer (for example, an ink-transporting layer) comprising a film-forming, hydrophobic binder and fusible, polymeric particles of a non-segmented polyurethane, or salt thereof, comprising a polymer that is the reaction product of a mixture of monomers comprising at least one diisocyanate, and a diol component comprising a mixture of diols, said diol mixture comprising: an anionically-substituted diol selected from carboxylic acid-, sulfonic acid-, and phosphonic acid-substituted diol comprising not more than 20 mole percent of said diol component, and at least one short chain aliphatic diol comprising at least 80 mole percent of the total diol content at least 60 mole percent of which is an ether-containing short chain aliphatic diol, and said polyurethane having a Tg greater than about 70° C.

The present porous inkjet recording element is obtained which has good abrasion resistance prior to fusing, and which when printed with an inkjet ink, and subsequently fused, has good water-resistance, does not unduly crack on bending, and has good resistance to thermal blocking.

Another embodiment of the invention relates to an inkjet printing method comprising the steps of: A) providing an inkjet printer that is responsive to digital data signals; B) loading the inkjet printer with the inkjet recording element described above; C) loading the inkjet printer with an inkjet ink composition; D) printing on the herein-described inkjet recording element using the inkjet ink composition in response to the digital data signals; and E) fusing at least the uppermost fusible, porous topmost layer. In a preferred embodiment, only the uppermost fusible layer is fused. However, the printing method can further comprise simultaneously fusing the underlying porous ink-fluid receiving layer in addition to the fusible porous topmost layer, such that both layers are non-porous.

The term "porous layer" is used herein to define a layer that absorbs applied ink by means of capillary action rather than liquid diffusion. (Similarly, the term porous element refers to an element having at least one porous layer, at least the ink-receiving layer.) Porosity can be affected by the particle to binder ratio. The porosity of a mixture may be predicted based on the critical pigment volume concentration (CPVC).

As used herein, the terms "over," "above," "upper," "under," "below," "lower," and the like, with respect to layers in the inkjet media, refer to the order of the layers over the support, but do not necessarily indicate that the layers are immediately adjacent or that there are no intermediate layers.

As used herein, the term "ink-receiving layer" includes any layer that is receptive to a substantial portion of applied ink fluid.

The term "ink-receiving layer" includes all layers that are receptive to an applied ink composition, that absorb or trap any part of the one or more ink compositions, or components thereof, used to form the image in the inkjet recording element, including the ink-carrier fluid and/or the colorant, which may include pigment-based or dye-based colorants. An ink-receiving layer, therefore, can include either an image-receiving layer, in which the image is formed by a dye and/or pigment, or an ink-carrier-liquid receptive layer in which the carrier liquid in the ink composition is absorbed upon application, although later removed by drying. Typically, all layers above the support are ink-receptive and the support may or may not be ink-receptive.

The term "thermoplastic polymer" is used herein to define the polymer flows upon application of heat, typically prior to any extensive crosslinking.

DETAILED DESCRIPTION OF THE INVENTION

As noted above, the fusible, polymeric particles employed in the invention are derived from a thermoplastic polymer that is a non-segmented polyurethane comprising: a diisocyanate, a diol component comprising a mixture of diols, said diol mixture comprising: an anionically substituted diol selected from carboxylic acid-, sulfonic acid-, and phosphonic acid-substituted diol, and at least one short chain aliphatic diol comprising at least one ether-containing, short chain aliphatic diol, the polyurethane having a Tg greater than about 70° C. The ether-containing, short chain aliphatic diol comprises at least 60 mole percent of the short chain aliphatic diol component, and the anionically-substituted diol comprises not more than 20 mole percent of the total diol component.

Polyurethanes are prepared via copolymerization of isocyanates and diols. Usual practice is to employ a mixture of short chain and polymeric diols, which generally affords phase separation in the polymer into distinct crystalline or hard, and amorphous or soft domains. The domain enriched in the polymeric diol component is generally referred to as the "soft-segment" domain, whereas domains enriched in the short chain diols are referred to as "hard-segment" domains. The soft-segment domain generally imparts a low glass transition temperature and high flexibility to films of the polyurethane. While the flexibility is highly desirable, the low glass transition temperature has lead to problems with thermal blocking. The "hard-segment" domains have much higher glass transition or melting temperatures, but absent significant soft-segment domains films are quite brittle and easily crack on bending. It has proven possible however to overcome the brittleness in films devoid of soft-segment domains by incorporating short chain ether containing diols. They impart flexibility into films devoid of soft-segment domains. The non-segmented polyurethanes comprising the fusible, polymeric particles of the invention are one hundred percent hard-segment polymers, in that they do not contain a polymeric diol component. They do have a critical level, however, of incorporated flexibilizing ether containing short chain diol.

In a preferred embodiment of the invention, the non-segmented polyurethane polymers has the following general formula:

Structure I

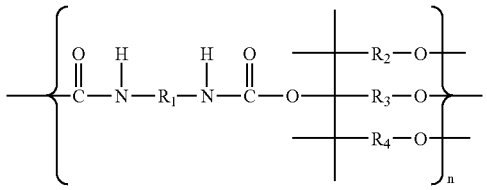

$R_1$, the diisocyanate component employed in the invention, can be represented by one or more of the following structures:

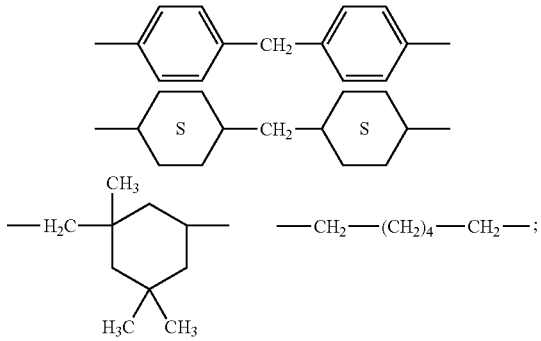

wherein "S" in a ring indicates that the ring is saturated, in this case a cyclohexane ring.

The group $R_2$ (different from $R_3$ and $R_4$ below) is derived from a diol employed in the invention to introduce the ionic portion of the polymer and is a diol containing a carboxylate, sulfonate, or phosphonate group. The repeat unit is used in the composition at 1 to 20 mole percent, preferably 5 to 15 mole percent, based on the total diol component. In a preferred embodiment $R_2$ is derived from dimethylolpropionic acid.

The group $R_3$ is derived from an ether-containing, short chain aliphatic diol which can be 2,2'-oxydiethanol, triethylene glycol, tetraethylene glycol or dipropylene glycol and the corresponding monomer is used in the composition at 60% to 100 mole percent based on the total diol component. The ether-containing, short chain aliphatic diols, impart a degree of flexibility, and are characterized as flexibilizing diols. By the term "short chain" is meant that the diol has a molecular weight of less than 500, preferably less than 200. Short chain diols can include straight, branched and cyclic aliphatic diols, preferably having less than 12 carbon atoms.

The group $R_4$ is derived from an aliphatic diol and is optionally used in the composition at 0% to 40 mole percent, preferably 1 to 25 mole percent based on the total diol component in the polymer and can be derived from ethylene glycol, propylene-1,2-glycol, propylene-1,3-glycol, butane-1,4-diol, hexane-1,6-diol, octane-1,8-diol, neopentyl glycol, 2-methyl propane-1,3-diol, or the various isomeric bis-hydroxymethylcyclohexanes.

The fusible, polymeric particles employed in the invention may have any particle size provided they will form a porous layer. In a preferred embodiment of the invention, the particle size of the fusible, polymeric particles may range from about 0.5 to 10 μm.

The film-forming, hydrophobic binder useful in the invention can be any film-forming hydrophobic polymer capable of being dispersed in water. In a preferred embodiment of the invention, the hydrophobic binder is an aqueous dispersion of an acrylic polymer or a polyurethane.

The particle-to-binder ratio of the particles and binder employed in the porous, fusible topmost layer can range between about 98:2 and 60:40, preferably between about 95:5 and 80:20. In general, a layer having particle-to-binder ratios above the range stated will usually not have sufficient cohesive strength; and a layer having particle-to-binder ratios below the range stated will usually not be sufficiently porous to provide good image quality.

The lower porous ink-fluid receiving layer can be any porous structure. It may be comprised of refractory inorganic materials or fusible thermally compliant materials, or mixtures thereof. Said ink-receiving layer may optionally contain mordant. It is preferred that the mean pore radius in the lower ink-receiving layer is smaller than that of the fusible, porous uppermost layer. Thus, if the ink-receiving layer is composed of particles and binder, the particles will be significantly smaller than the fusible, polymeric particles in the uppermost fusible porous layer, thereby assuring a correct pore-size hierarchy. The correct pore-size hierarchy assures that the ink is withdrawn from the large capillaries of the topmost porous, fusible layer and retained in the smaller capillaries of the ink-receiving layer.

In general, the ink-receiving layer or layers will have a thickness of about 1 μm to about 50 μm, and the topmost fusible porous layer will usually have a thickness of about 2 μm to about 50 μm. In a preferred embodiment, the ink-receiving layer is present in an amount from about 1 $g/m^2$ to about 50 $g/m^2$, preferably from about 5.0 $g/m^2$ to about 30 $g/m^2$.

In a preferred embodiment of the invention, the ink-receiving layer is a continuous, co-extensive porous layer that contains organic or inorganic particles. Examples of organic particles which may be used include core/shell particles such as those disclosed in U.S. Pat. No. 6,492,006 of Kapusniak et al. and homogeneous particles such as those disclosed in U.S. Pat. No. 6,475,602 of Kapusniak et al., the disclosures of which are hereby incorporated by reference. Examples of organic particles which may be used include acrylic resins, styrenic resins, cellulose derivatives, polyvinyl resins, ethylene-allyl copolymers and polycondensation polymers such as polyesters. Examples of inorganic particles which may be used in the ink-receiving layer of the invention include silica, alumina, titanium dioxide, clay, calcium carbonate, barium sulfate, or zinc oxide.

In a preferred embodiment of the invention, the porous ink-receiving layer comprises from about 20% to about 100% of particles and from about 0% to about 80% of a polymeric binder, preferably from about 80% to about 95% of particles and from about 20% to about 5% of a polymeric binder. The polymeric binder may be a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly (acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The porous ink-receiving layer can also comprise an open-pore polyolefin, an open-pore polyester or an open pore membrane. An open pore membrane can be formed in accordance with the known technique of phase inversion. Examples of a porous ink-receiving layer comprising an open-pore membrane are disclosed in U.S. Pat. No. 6,497,941 and U.S. Pat. No. 6,503,607, both of Landry-Coltrain et al.

In another preferred embodiment of the invention, two porous, ink-receiving layers are present. In this embodiment, the uppermost layer is substantially the same as the lower layer, but at a thickness of only 1% to 20% of the thickness of the lower layer, and also contains from about 1-20% by weight of a mordant, such as a cationic latex mordant.

The two porous, ink-receiving layers can be coated simultaneously or sequentially by any of the known coating techniques as noted below. The dye image is then concentrated at the thin uppermost ink-receiving layer containing a mordant, and thereby enhances print density.

The support used in the inkjet recording element of the invention may be opaque, translucent, or transparent. There may be used, for example, plain papers, resin-coated papers, various plastics including a polyester resin such as poly (ethylene terephthalate), poly(ethylene naphthalate) and poly(ester diacetate), a polycarbonate resin, a fluorine resin such as poly(tetra-fluoro ethylene), metal foil, vinyl, fabric, laminated or coextruded supports, various glass materials, and the like. In a preferred embodiment, the support is a resin-coated paper. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer or solvent-absorbing layer to the support.

Since the image recording element may come in contact with other image recording articles or the drive or transport mechanisms of image recording devices, additives such as surfactants, lubricants, UV-absorbing agents, matte particles and the like may be added to the element to the extent that they do not degrade the properties of interest.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

After printing on the element of the invention, the fusible, porous topmost layer is heat and/or pressure fused to form an overcoat layer on the surface. Fusing is preferably accomplished by contacting the surface of the element with a heat fusing member, such as a fusing roller or fusing belt. Thus, for example, fusing can be accomplished by passing the element through a pair of heated rollers, heated to a temperature of about 60° C. to about 160° C., using a pressure of about 0.35 to about 0.70 MPa at a transport rate of about 0.005 m/sec to about 0.5 m/sec.

Inkjet inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

The polymer syntheses of the following non-segmented Polyurethanes (100% Hard Segment Polymers), polymers U-1 and U-2 according to the present invention, and comparative polymers U-3 and U-4, differed only in the weight percent of flexibilizing aliphatic diol. The polymer synthesis of Comparative Polymer U-5 which is segmented polyurethane is then described.

Synthesis of Comparative Non-Segmented, 100% Hard Segment Polyurethane Having 20% by weight of Flexibilizing Diol, designated Comparative Polvmer U-4.

In a 2 liter resin flask equipped with a thermometer, stirrer, water condenser was added 6.5 g (0.0485 mole) 2,2-Bis(hydroxymethyl)propionic acid, 10 g (0.094 mole) 2,2'-oxydiethanol, 32.22 g (0.36 mole) 1,4-butanediol, 100 g of reagent grade Ethyl Acetate, and 1.6 g of stannous octoate (catalyst). The temperature was adjusted to 80° C. and the contents stirred for about 30 minutes at which time the solution becomes clear. The temperature was lowered to 70° C. and while stirring, 111.20 g (0.50 mole) of isophrone diisocyanate and 10 g ethyl acetate were added. The temperature was raised to 72° C. and the reaction stirred at temperature until completion, after which 50 g tetrahydrofurane was added as a co-solvent and the reaction was cooled. The solution was used to prepare the polyurethane particles P-4 described below.

Synthesis of Comparative Non-Segmented. 100% Hard Segment Polyurethane Having 50 weight % of Flexibilizing Diol, designated Comparative Polymer U-3.

In a 2 liter resin flask equipped with a thermometer, stirrer, water condenser was added 6.5 g (0.0485 mole) 2,2-Bis(hydroxymethyl)propionic acid, 23.96 g (0.23 mole) 2,2'-oxydiethanol, 20.34 g (0.23 mole) 1,4-butanediol, 170 g of reagent grade Ethyl Acetate, and 0.41 g of stannous octoate (catalyst). The temperature was adjusted to 80° C. and the contents stirred for about 30 minutes at which time the solution becomes clear. The temperature was lowered to 70° C. and while stirring, 111.20 g (0.50 mole) of isophrone diisocyanate and 10 g ethyl acetate were added. The temperature was raised to 85° C. and the reaction stirred at temperature until completion, after which 42 g tetrahydrofurane was added as a co-solvent and the reaction was cooled. The solution was used to prepare the polyurethane particles P-3 described below.

Synthesis of Non-Segmented 100% Hard Segment Polyurethane Having 75 weight % of Flexibilizing Diol, designated Polymer U-2.

In a 2 liter resin flask equipped with a thermometer, stirrer, water condenser was added 6.5 g (0.0485 mole) 2,2-Bis(hydroxymethyl)propionic acid, 35.94 g (0.3387 mole) 2,2'-oxydiethanol, 10.17 g (0.1129 mole) 1,4-butanediol, 120 g of reagent grade Ethyl Acetate, and 0.41 g of stannous octoate (catalyst). The temperature was adjusted to 80° C. and the contents stirred for about 30 minutes at which time the solution becomes clear. The temperature was lowered to 70° C. and while stirring, 111.20 g (0.50 mole) of isophrone diisocyanate and 10 g ethyl acetate were added. The temperature was raised to 85° C. and the reaction stirred at temperature until completion which gave, upon cooling, a 55.8 weight percent solids solution. The solution was used to prepare the polyurethane particles P-2 described below.

Synthesis of Non-Segmented Polyurethane 100% Hard Segment Polyurethane Having 100 weight % of Flexibilizing Diol, designated Polymer U-1.

In a 2 liter resin flask equipped with a thermometer, stirrer, water condenser was added 6.5 g (0.0485 mole) 2,2-Bis(hydroxymethyl)propionic acid, 47.91 g (0.452 mole) 2,2'-oxydiethanol, 150 g of reagent grade Ethyl Acetate, and 0.41 g of stannous octoate (catalyst). The temperature was adjusted to 80° C. and the contents stirred for about 30 minutes at which time the solution becomes clear. The temperature was lowered to 70° C. and while stirring, 111.20 g (0.50 mole) of isophrone diisocyanate and 10 g ethyl acetate were added. The temperature was raised to 76° C. and the reaction stirred at temperature until completion, after which 50 g tetrahydrofurane was added as a co-solvent and the reaction was cooled. The solution was used to prepare the polyurethane particles P-1 described below.

Synthesis of Comparative Segmented, 67% Hard Segment Polyurethane, designated Comparative Polymer U-5

In a 2 liter resin flask equipped with thermometer, stirrer, water condenser and vacuum outlet, 123 g (0.041 mole) Polyester polyol Tone® 0260 (a polymeric diol), MW 3000, was melted and dewatered under vacuum at 90° C. The vacuum was released and at 40° C. there was then added 10.20 g (0.076 mole) 2,2-Bis(hydroxymethyl) propionic acid, 128.76 g (0.383 mole) Hexafluorobisphenol A, 75 g of Reagent grade Ethyl Acetate, and 20 drops of Dibutyltin Dilaurate (catalyst). The temperature was adjusted to 80° C. and the contents stirred for 30 minutes. The temperature was lowered to 70° C. and while stirring, 111.20 g (0.50 mole) of isophrone diisocyanate and 10 g ethyl acetate were added. The temperature was raised to 80° C. and reaction stirred at temperature until completion which gave, upon cooling, a 60.6 weight percent solids solution. The solution was used to prepare the polyurethane particles P-5 described below.

Preparation of Fusible, Polymeric Particles

The preparation of the fusible polymeric particles was identical for all the polyurethanes and the procedure below is illustrative: where Particles, P-1 were prepared from polymer, U-1, particles, P-2, were prepared from polymer, U-2, and so on.

Preparation of Fusible, PolyMeric Particles, P-1, from Non-segmented Polyurethane, U-1.

To 194.8 g of the above 60.6% weight percent solids polyurethane, U-1, dissolved in ethyl acetate described above was added 172.0 g of ethyl acetate and 4.0 g of triethanolamine. A separate aqueous composition was prepared by mixing 26.8 g of ethyl acetate and 1202.4 g of deionized water. The organic composition was added slowly to the aqueous composition using a low shear propeller mixing device. The resulting oil-in-water emulsion was then subjected to a high shear Brinkman rotor-stator mixer for 5 minutes at 5000 rpm. The ethyl acetate was removed by rotary evaporation under vacuum at 68° C. and the particles were concentrated to afford a 30% solids dispersion having a mean particle diameter of 2 μm.

Preparation of Coating Solutions for Fusible Porous Upper Laver

Coating solution S1 was prepared by adding to the P1 particles the hydrophobic binder Witcobond ®W320, an aqueous dispersion of 1.9 micron polyurethane particles Tg=−12° C. The coating solution at 20% solids comprised 90 parts by weight P1 particle solids and 10 parts by weight binder solids.

The corresponding coating solutions, S2 to S5 were identically prepared using particles P2 to P5.

Preparation of Porous Ink-Fluid receiving Lower Layers

A polyethylene resin-coated paper support was corona discharge treated. The support was then hopper coated and force air dried at 60° C. to provide the following ink-receiving layers which were simultaneously coated:

Lower Layer L1—a 38 μm layer comprising 87% fumed alumina, 9% poly(vinyl alcohol), and 4% dihydroxydioxane crosslinking agent Upper Layer L2—a 2 μm layer comprising 87% fumed alumina, 8% 100 nm colloidal latex dispersion of divinylbenzene-co-N-vinylbenzyl-N,N,N -trimethylammonium chloride, 6% poly(vinyl alcohol), and 1% Zonyl ®FSN surfactant (DuPont Corp.).

Elements of the Invention

The topmost fusible porous layer was prepared by separately hopper coating solutions as shown in Table 1 over the porous ink-receiving layers as shown in Table 1 to give a solids laydown of 800 mg/m$^2$.

Control Elements C-1 through C-3

These elements were prepared the same as Elements of the invention except using the solutions as shown in Table 1.

Control Element C-4

A commercially available sample of fusible media, Canon Hyperphoto,® media was tested.

Fusing

Element and control samples were fused in a heated nip at 150° C. and 0.41 MPa against a sol-gel coated polyimide belt at 0.0128 m/sec.

Cracking Test

Fused coatings were wrapped 180° around a 6.35 mm diameter mandrel with the coated side face out and held for one minute. The coating was then unwrapped from the mandrel and a small amount of Ponceau Red dye applied to the bent area. After ten seconds the excess dye was blotted off. Continuous cracking evidenced by the appearance of red lines in the test area was recorded as a fail.

Thermal Blocking Test

Fused coatings were cut into 76.2 mm square samples and conditioned for six hours at 50% RH. A pair of the samples was then placed face-to-face, and loaded under a 1 kg weight at 70° C. for 6 hr. The samples were then allowed to cool to ambient temperature and rated on the difficulty encountered in separating the thus treated samples. Samples that firmly stuck together or evidenced severe damage in separated samples were rated a fail.

TABLE 1

| Element | Coating Solution | Particles | Polymer | Tg | % HS | % Flex Diol | Cracking | Blocking |
|---|---|---|---|---|---|---|---|---|
| 1 | S-1 | P-1 | U-1 | 85 | 100 | 100 | Pass | Pass |
| 2 | S-2 | P-2 | U-2 | 93 | 100 | 68 | Pass | Pass |
| C1 | S-3 | P-3 | U-3 | 92 | 100 | 50 | Fail | Pass |
| C2 | S-4 | P-4 | U-4 | 98 | 100 | 20 | Fail | Pass |
| C3 | S-5 | P-5 | U-5 | 69 | 67 | — | Pass | Fail |
| C4 | — | — | — | — | — | — | Fail | Fail |

The results show that Elements 1 and 2 of the invention have simultaneously good flexibility and thermal blocking properties, whereas the control elements do not.

In similar testing involving printing using a Hewlett-Packard Photosmart® printer and print cartridges C3844A and C3845A, with 3 cm$^2$ color patches at 100% density in each of the primary and secondary colors and black between unprinted areas, the inkjet elements exhibited no sticking in the unprinted areas, but some damage in the printed areas. In order to obtain even less thermal blocking, an increased mole percent of the non-ether containing short chain diol may be used in the fusible polymers. Alternatively, inkjet ink compositions used for printing may be limited to printers that use inkjet ink compositions having less than 15 weight percent of plasticizing compounds or humectants such as 1,6-hexanediol.

What is claimed is:

1. An inkjet recording element comprising a support having thereon in order from the support:

a) at least one porous, ink-receiving layer; and b) a fusible, porous topmost layer comprising a film-forming, hydrophobic binder and fusible, polymeric particles of a non-segmented polyurethane, or salt form thereof, comprising the polymerization reaction product of a diisocyanate and a diol component comprising a mixture of diols, said diol mixture comprising: an anionically substituted diol selected from carboxylic acid-, sulfonic acid-, and phosphonic acid-substituted diol comprising from 1 to 20 mole percent of said diol component, and at least one short chain aliphatic diol comprising at least 80 mole percent of the total diol content at least 60 mole percent of which is an ether containing short chain aliphatic diol, wherein said polyurethane having a Tg greater than about 70° C.

2. The element of claim 1 wherein said polyurethane has a Tg of from about 80° C. to about 100° C.

3. The element of claim 1 wherein said ether-containing, short chain aliphatic diol is diethylene glycol, triethylene glycol, or tetraethylene glycol.

4. The element of claim 1 wherein said anionically substituted diol is a carboxylic acid-substituted diol.

5. The element of claim 4 wherein said carboxylic acid-substituted diol is dimethylol propionic acid.

6. The element of claim 1 wherein the particle size of said fusible, polymeric particles is from about 0.5 to about 10 μm.

7. The inkjet recording element of claim 1 wherein the particle-to-binder ratio of the topmost fusible porous layer is between about 95:5 and 60:40.

8. The element of claim 1 wherein said porous, ink-receiving layer comprises from about 20% to about 100% of particles and from about 0% to about 80% of a polymeric binder.

9. The element of claim 8 wherein said particles comprise silica, alumina, titanium dioxide, clay, calcium carbonate, barium sulfate or zinc oxide.

10. The element of claim 8 wherein said polymeric binder is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin.

11. The element of claim 1 wherein said topmost layer has a thickness of about 1 μm to about 25 μm and said ink-receiving layer has a thickness of about 2 μm to about 50 μm.

12. The element of claim 1 wherein said hydrophobic binder comprises polyurethane or an acrylic polymer.

13. An inkjet recording element comprising a support having thereon in order from the support:

a) at least one porous, ink-receiving layer; and b) a fusible, porous topmost layer comprising a film-forming, hydrophobic binder and fusible, polymeric particles of a non-segmented polyurethane, or salt form thereof, comprising a diisocyanate and a diol component comprising the polymerization reaction product of a mixture of diols, said diol mixture comprising: an anionically-substituted diol selected from carboxylic acid-, sulfonic acid-, and phosphonic acid-substituted diol comprising from 1 to 20 mole percent of said diol component, and at least two short chain aliphatic diols comprising at least 80 mole percent of the total diol content at least 60 mole percent of which is an ether-containing short chain aliphatic diol and not more than 40 mole percent of which is a short chain aliphatic diol not containing an ether, wherein said polyurethane having a Tg greater than about 70° C.

14. The inkjet recording element of claim 13 wherein the fusible, porous topmost layer is an ink-transporting layer and the porous, ink-receiving layer is an image-receiving layer.

15. An inkjet printing method, comprising the steps of:

a) providing an inkjet printer that is responsive to digital data signals;

b) loading the printer with the inkjet recording element of claim 1;

c) loading the printer with an inkjet ink composition;

d) printing on the inkjet recording element using the inkjet ink composition in response to the digital data signals; and e) fusing at least the fusible, porous topmost layer such that the layer is non-porous.

16. The method of claim 15 wherein the fusible, porous topmost layer is an ink-transporting layer and the inkjet ink composition is a dye-based-ink composition.

17. The method of claim 15 wherein the inkjet ink composition is a dye-based ink and the method further comprises simultaneously fusing the at least one porous, ink-receiving layer in addition to the fusible, porous topmost layer, such that both layers are non-porous.

18. The method of claim 15 wherein the fusible porous topmost layer is an ink-transporting layer and the ink-receiving layer is an image-receiving layer.

19. The method of claim 1 wherein said fusible, porous topmost layer was prepared by coating on said ink-receiving layer an aqueous dispersion of said fusible, polymeric particles and particles of said film-forming, hydrophobic binder, followed by drying.

* * * * *